United States Patent [19]

Grassmann

[11] 4,428,127

[45] Jan. 31, 1984

[54] DRYING APPARATUS FOR DYEING BOBBINS IN THE TEXTILE INDUSTRY

[75] Inventor: Hans-Christian Grassmann, Baiersdorf, Fed. Rep. of Germany

[73] Assignee: Siemens Aktiengesellschaft, Munich, Fed. Rep. of Germany

[21] Appl. No.: 422,964

[22] Filed: Sep. 24, 1982

[30] Foreign Application Priority Data

Oct. 23, 1981 [DE] Fed. Rep. of Germany ..... 3142172

[51] Int. Cl.[3] ..... F26B 13/10; D06B 15/00

[52] U.S. Cl. ..... 34/1; 34/68; 34/105; 68/19.1

[58] Field of Search ..... 68/19.1, 5 C, 8; 34/1, 34/4, 39, 68, 105, 216

[56] References Cited

U.S. PATENT DOCUMENTS

| | | | |
|---|---|---|---|
| 2,698,488 | 1/1955 | Cannon et al. | 34/1 |
| 3,071,868 | 1/1963 | Kalman | 34/105 |
| 4,304,048 | 12/1981 | Smith et al. | 34/105 X |

FOREIGN PATENT DOCUMENTS

| | | | |
|---|---|---|---|
| 2299443 | 8/1976 | France | 68/8 |
| 2047396 | 11/1980 | United Kingdom | 34/39 |

*Primary Examiner*—Philip R. Coe

*Attorney, Agent, or Firm*—Kenyon & Kenyon

[57] ABSTRACT

An automatic drying apparatus for dyeing bobbins in the textile industry, in which the bobbins, slipped onto a perforated tube, are first predried with compressed air, followed by an intermediate drying operation of the bobbin surfaces with infrared heaters and final drying then performed capacitively in a high-frequency oven. The tube with the bobbins thereon is transported through the apparatus as a unit by a transporting device.

6 Claims, 2 Drawing Figures

DRYING APPARATUS FOR DYEING BOBBINS IN THE TEXTILE INDUSTRY

BACKGROUND OF THE INVENTION

This invention relates to a drying apparatus for drying thread on dyeing bobbins used in the textile industry of the type in which, for dyeing, a plurality of bobbins are simultaneously plugged onto a perforated tube by means of which the liquid dyeing agent is forced through the bobbins.

Presently, for drying, the bobbins are removed from the tube, are predried in a mechanical device, for instance, by a centrifuge and are subsequently dried completely in a high-frequency oven. Hot air is also blown into this oven and drawn off again to equalize the heating and for removing the vapor clouds produced.

Drying apparatus of this kind has found acceptance over purely mechanical drying apparatus, but the necessary separating of the bobbin is still an obstacle to far-reaching automation of the material flow in the drying process.

It is an object of the present invention to automate and accelerate to a high degree the drying process in drying apparatus of the kind mentioned at the outset.

SUMMARY OF THE INVENTION

The solution of this problem is accomplished according to the present invention by apparatus including:

A predrying station, in which means for blowing compressed air into the tube with the bobbins slipped on are provided;

A following intermediate drying station for drying off the surfaces of the bobbins slipped onto the tube;

A full-drying station connected thereto with a high-frequency oven for the capacitive final drying of the bobbins on the tube; and A transporting device for the automatic transport of the dyeing bobbins which have been slipped onto the tube through the individual stations, which is provided, at least in the region of the high-frequency oven, with means for rotating the tube with bobbins about its longitudinal axis.

By means of such a treatment line, the passage and the heat treatment time can be shortened and manual working time for work pieces for the drying process can be saved. From a physical point of view, a large part of the moisture is removed in the predrying station by blowing in compressed air, for instance, at 5 atmospheres, from the interior through the bobbins to the surface, and removing it there. However, a bobbin predryed and prepared in this manner is not immediately suitable for a subsequent high-frequency treatment because, due to the nature of the above-mentioned drying, a relatively large amount of moisture still remains at the surface, which would cause spark-overs in the high frequency field. An intermediate station for surface drying, for instance, with infrared radiators must therefore be provided in the production line between the mechanical predrying station and the high-frequency dryer.

For simplifying the mechanical design, the conveyor is preferably operated cyclically in the region of the mechanical predrying, i.e., while the compressed air is being blown into the tubes, the respective conveyer section is standing still, but continuous transporting operation can proceed at the other treatment stations. So that the air can emerge freely and the bobbins are dried uniformly, the transporting device, for instance, in the form of a chain conveyer, is provided with spacers in which the tubes with bobbins are inserted.

DETAILED DESCRIPTION

Figure 1:
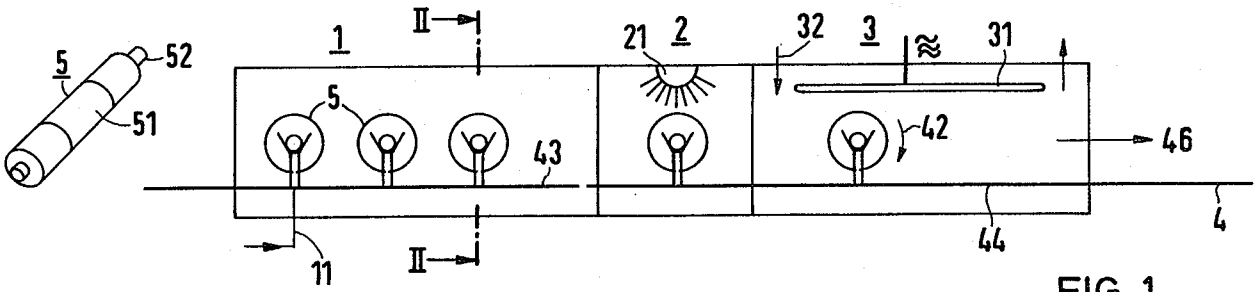
FIG. 1 is a schematic longitudinal section through the drying apparatus.
Figure 2:
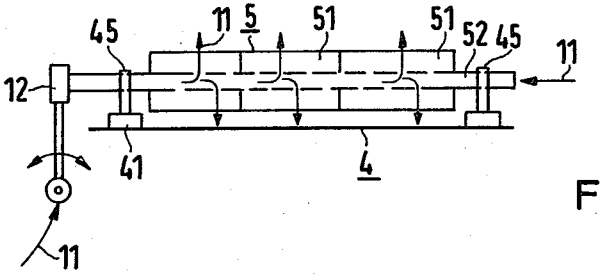
FIG. 2 is a section along the line II—II in FIG. 1.

The drying apparatus for the individual dyeing bobbins 51, i.e., bobbins with thread or yarn which has been dyed and which are still wet, pushed onto a perforated tube 52, includes a mechanical predrying station 1, an intermediate drying station 2 for surface drying, and a final drying station 3 connected thereto. The unit 5 consisting of the tube 52 and the bobbins 51 is transported by means of a transporting device 4 through the individual stations in the direction of the arrow 46. To this end, the chain conveyors 41 of the transporting device 4 are provided with spacers 45, into which the tubes 52 together with the bobbins 51 are inserted.

The predrying station 1 is provided with connecting devices 12 for compressed air 11. Several tubes can be connected at the same time. So that the connecting operation and the drying present no excessively great difficulties, the conveyer device 4 is stopped during this process in the area 43 which is in the predrying station 1.

When the bobbins have been sufficiently predried mechanically and processed by blowing in compressed air with a pressure of, for instance, 5 atmospheres, the units 5 are transferred into an intermediate drying station 2 which is equipped with infrared radiators 21. There, the surface of the bobbins 51 is freed of moisture. From there, the bobbins 51 on the tube 52 arrive as a complete unit 5 for final drying in the station 3 which consists of a known high frequency oven with electrodes 31. Into this oven, hot air 32 is also blown and drawn off again. For uniform drying of the bobbins, means are provided in this region, and optionally also in the region of the intermediate drying station 2, for rotating the tube 52 about its longitudinal axis in the direction of the arrow 42. Such rotation is necessary if the tube with the bobbins is perpendicular to the field lines in the high frequency oven, since otherwise nonuniform drying zones would be generated. Such a physical arrangement has the advantage that metallic sleeves can be used for winding the bobbins without short-circuiting the field. If the tube is to be arranged in the direction of the electric field line, a bobbin core and tubes of insulating material must be provided.

The electrodes 31, and thereby the transporting device, may also be arranged vertically instead of horizontally as shown.

What is claimed is:

1. In drying apparatus for dyeing bobbins of the kind used in the textile industry and which are dyed in a process in which a plurality of bobbins are simultaneously slipped onto a perforated tube, through which the liquid dyeing agent is forced into and through the thread or yarn wound on the bobbin core for dyeing, said apparatus including:

(a) a mechanical predrying device for the bobbins; and (b) a high frequency oven into which hot air can also be blown, the improvement comprising:

(c) the predrying station including means for blowing compressed air into the tube with bobbins slipped thereon;

(d) an intermediate drying station following thereafter for drying off the surfaces of the dyeing bobbins slipped onto the tube;

(e) a final drying station following thereafter including the high frequency oven for the capacitive final drying of the bobbins on the tube; and (f) a transporting device for the automatic transport of the dyeing bobbins slipped onto the tube through the individual stations and including, at least in the region of the high-frequency oven, means for rotating the tube with the bobbins about its longitudinal axis.

2. Drying apparatus according to claim 1, wherein said intermediate drying station includes means for the infrared drying of the surfaces of the bobbins.

3. Drying apparatus according to claim 1, wherein said predrying station includes means for the simultaneous connection of several tubes to compressed air, and wherein said transporting device is provided with a cyclic transport in the region of said predrying station.

4. Drying apparatus according to claim 1, wherein said transporting device includes means for holding the tube with the bobbins in a direction perpendicular to the course of the field lines in the high-frequency oven.

5. Drying apparatus according to claim 4, wherein said transporting device comprises a chain conveyer provided with spacers for receiving the tube ends.

6. Drying apparatus according to claim 1, wherein said transporting device and the electrodes are arranged horizontally in the high-frequency oven.

* * * * *